US011569046B2

(12) United States Patent
Chan et al.

(10) Patent No.: US 11,569,046 B2
(45) Date of Patent: Jan. 31, 2023

(54) KEYSWITCH WITH MEMBER AND SUPPORT DEVICES

(71) Applicant: DARFON ELECTRONICS CORP., Taoyuan (TW)

(72) Inventors: Chin-Lung Chan, Taoyuan (TW); Cheng-Min Su, Taoyuan (TW); Hung-Chieh Lo, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 17/161,675

(22) Filed: Jan. 29, 2021

(65) Prior Publication Data

US 2021/0249200 A1 Aug. 12, 2021

(30) Foreign Application Priority Data

Feb. 6, 2020 (TW) ..... 109103611

(51) Int. Cl.

| | |
|---|---|
| ***H01H 3/12*** | (2006.01) |
| ***H01H 13/14*** | (2006.01) |
| ***H01H 13/7065*** | (2006.01) |
| ***H01H 13/04*** | (2006.01) |

(52) U.S. Cl.

CPC ..... *H01H 3/122* (2013.01); *H01H 13/04* (2013.01); *H01H 13/14* (2013.01); *H01H 13/7065* (2013.01); *H01H 2233/04* (2013.01)

(58) Field of Classification Search

CPC .... H01H 3/122; H01H 13/14; H01H 13/7065; H01H 13/04; H01H 2233/04; H01H 3/125; H01H 3/12

USPC ..... 200/341, 344, 345

See application file for complete search history.

(56) References Cited

U.S. PATENT DOCUMENTS

| | | | | |
|---|---|---|---|---|
| 9,455,097 | B2 * | 9/2016 | Chen | H01H 13/7065 |
| 10,325,735 | B2 * | 6/2019 | Yen | H01H 3/125 |

FOREIGN PATENT DOCUMENTS

| | | | |
|---|---|---|---|
| CN | 109545587 | A | 3/2019 |
| TW | M386584 | U1 | 8/2010 |
| TW | M500344 | U | 5/2015 |

* cited by examiner

*Primary Examiner* — Lheiren Mae A Caroc

(74) *Attorney, Agent, or Firm* — Winston Hsu

(57) ABSTRACT

A keyswitch includes a board, a cap opposite to the board, a first support device, a second support device, and a first link member. The first support device is disposed between the cap and the board. An end of the first support device is connected to the board. Another end of the first support device is connected to the cap. The second support device is disposed between the cap and the board and is separate from the first support device at a specific distance. An end of the second support device is connected to the board. Another end of the second support device is connected to the cap. The first link member has a first end portion and a second end portion. The first end portion is movably connected to the first support device. The second end portion is connected to the second support device.

18 Claims, 7 Drawing Sheets

KEYSWITCH WITH MEMBER AND SUPPORT DEVICES

BACKGROUND OF THE INVENTION

1. Field of the Invention

The present invention relates to a keyswitch, and more specifically, to a keyswitch utilizing movement of a link member on a support device for size adjustment.

2. Description of the Prior Art

A keyboard is the most common input device of a personal computer for users. The keyboard includes a plurality of keyswitches to input characters, symbols, numerals and so on. The keyswitch usually includes a board, a cap and a support device disposed between the cap and the board to make the cap movable between a non-pressed position and a pressed position relative to the board together with the support device. In general, the keyswitches have different sizes. Thus, it is necessary to design different support devices for the keyswitches on the keyboard according to the aforesaid different sizes, so as to make the mold designs of the support devices much complicated and increase the type and number of molds and the manufacturing cost of the keyboard.

SUMMARY OF THE INVENTION

The present invention provides a keyswitch including a board, a cap, a first support device, a second support device, and a first link member. The cap is opposite to the board. The first support device is disposed between the cap and the board. One end of the first support device is connected to the board, and another end of the first support device is connected to the cap. The second support device is disposed between the cap and the board and is spaced apart from the first support device at a specific distance. An end of the second support device is connected to the board, and another end of the second support device is connected to the cap. The first link member has a first end portion and a second end portion. The first end portion is movably connected to the first support device, and the second end portion is connected to the second support device.

These and other objectives of the present invention will no doubt become obvious to those of ordinary skill in the art after reading the following detailed description of the preferred embodiment that is illustrated in the various figures and drawings.

DETAILED DESCRIPTION

A keyswitch provided by the present invention includes a board, a cap opposite to the board, a first support device, a second support device, and a first link member. The first support device is disposed between the cap and the board. An end of the first support device is connected to the board, and another end of the first support device is connected to the cap. The second support device is disposed between the cap and the board and is spaced apart from the first support device at a specific distance. An end of the second support device is connected to the board, and another end of the second support device is connected to the cap. The first link member has a first end portion and a second end portion. The first end portion is movably connected to the first support device. The second end portion is connected to the second support device. To be more specific, before the first support device and the second support device are connected to the board, the first end portion could be preferably movable between a first position and a second position relative to the first support device. Accordingly, when the first end portion of the first link member moves to the first position relative to the first support device, the first support device and the second support device are spaced apart from each other at a first distance. When the first end portion of the first link member moves to the second position relative to the first support device, the first support device and the second support device are spaced apart from each other at a second distance. The first distance is larger than the second distance. In brief, the present invention can modify a position of the link member relative to the support devices to adjust a distance between the support devices for keyswitches of different sizes, so as to decrease the type and number of molds for manufacturing the support devices. As such, the manufacturing cost of the keyboard can be reduced. To be noted, the aforesaid design could be applied to connection between the first link member and the second support device. That is, the second end portion of the first link member could be movably connected to the second support device to be movable between a third position and a fourth position relative to the second support device. Accordingly, the present invention can modify a position of the first link member relative to the second support device for adjusting a distance between the first support device and the second support device.

Figure 1:
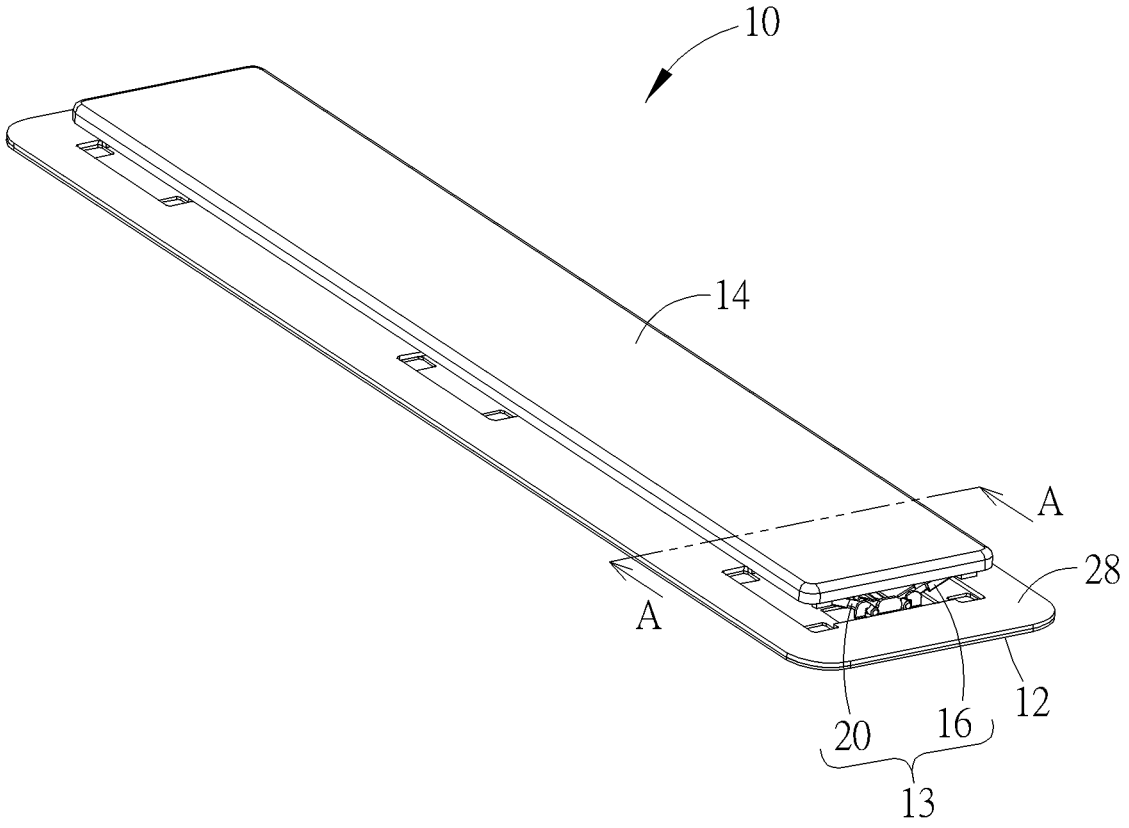
FIG. 1 is a diagram of a keyswitch according to an embodiment of the present invention.
Figure 2:
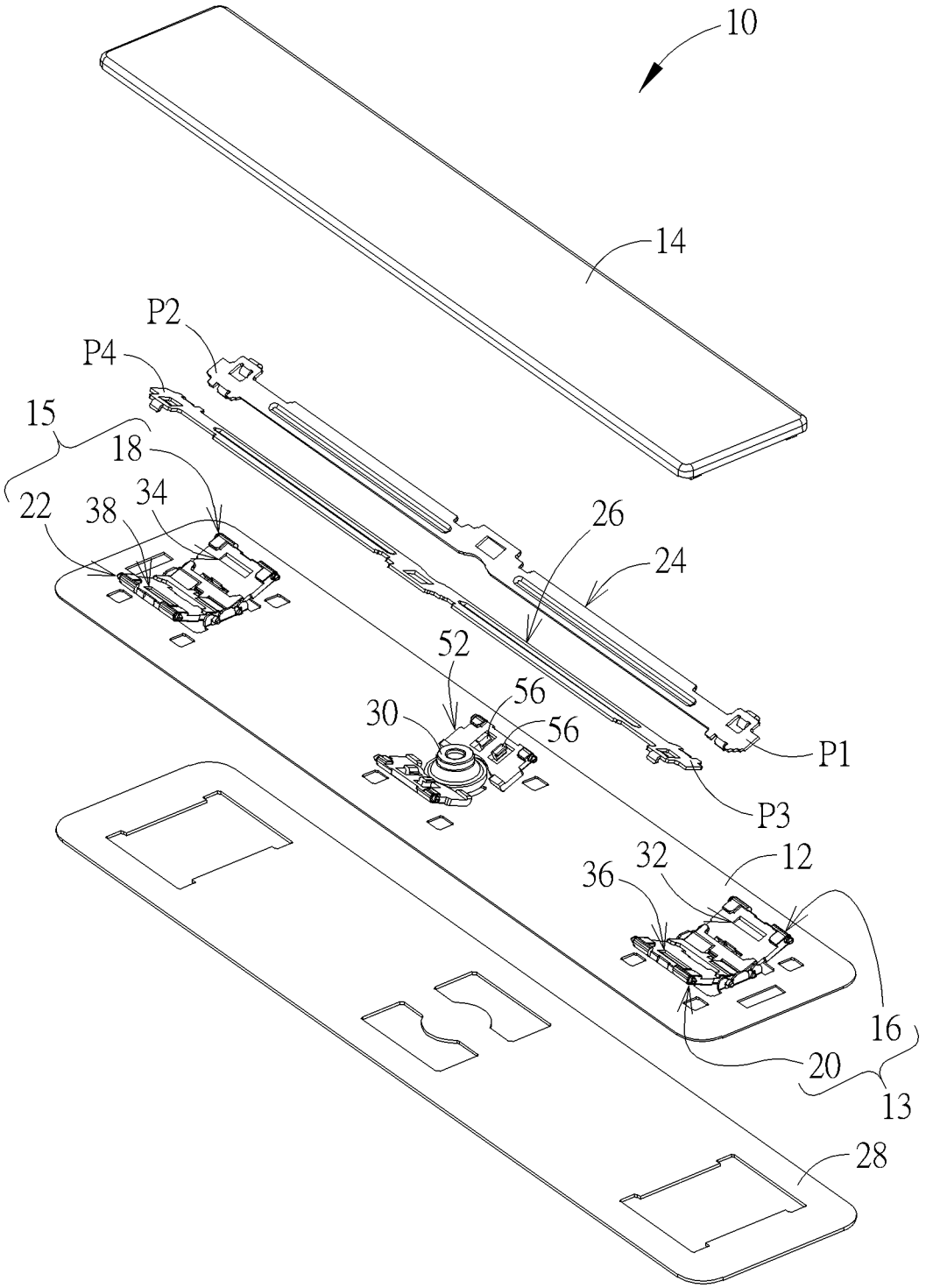
FIG. 2 is an exploded diagram of the keyswitch in FIG. 1.

For example, please refer to FIG. 1 and FIG. 2. FIG. 1 is a diagram of a keyswitch 10 according to an embodiment of the present invention. FIG. 2 is an exploded diagram of the keyswitch 10 in FIG. 1. As shown in FIG. 1 and FIG. 2, the keyswitch 10 includes a board 12, a first support device 13, a cap 14, a second support device 15, a first link member 24, and a second link member 26. The first support device 13 includes a first support member 16 and a third support member 20. The second support device 15 includes a second support member 18 and a fourth support member 22. In the practical application, the keyswitch 10 could further include a circuit board 28. The circuit board 28 could be a membrane circuit board, but not limited thereto. The circuit board 28 is disposed on the board 12 for providing a keyswitch triggering function. Furthermore, the keyswitch 10 could further include an elastic member 30. The elastic member 30 could be preferably a rubber dome, but not limited thereto. The elastic member 30 is disposed on the circuit board 28.

Accordingly, when the cap 14 is pressed by a user, the elastic member 30 can provide elastic force to the cap 14 for returning the cap 14 to its original position.

The cap 14 is disposed opposite to the board 12, and the first support member 16, the second support member 18, the third support member 20, and the fourth support device 22 are disposed between the cap 14 and the board 12. In this embodiment, the first support member 16 and the third support member 20 are preferably opposite to each other and abut against each other for cooperatively forming a butterfly lifting mechanism, so that the first support member 16 and the third support member 20 can rotate synchronously. The second support member 18 and the fourth support member 22 are preferably opposite to each other and abut against each other for cooperatively forming a butterfly lifting mechanism, so that the second support member 18 and the fourth support member 22 can rotate synchronously. As such, the cap 14 can move upward and downward relative to the board 12 with upward and downward movement of the first support member 16, the second support member 18, the third support member 20, and the fourth support member 22. To be noted, the present invention could adopt other cap lifting mechanism, such as a scissor lifting mechanism, and the related description could be reasoned by analogy according to this embodiment and omitted herein.

Figure 3:
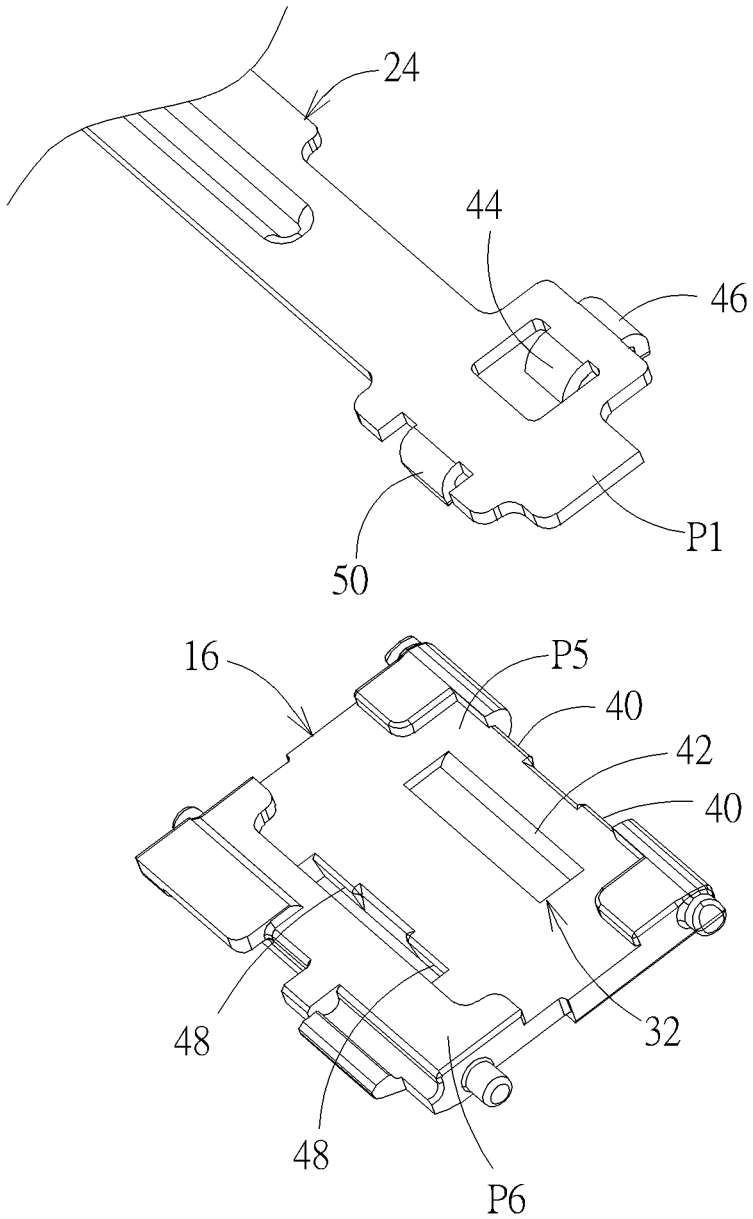
FIG. 3 is a partial enlarged diagram of a first support member and a first link member in FIG. 2 at another viewing angle.
Figure 4:
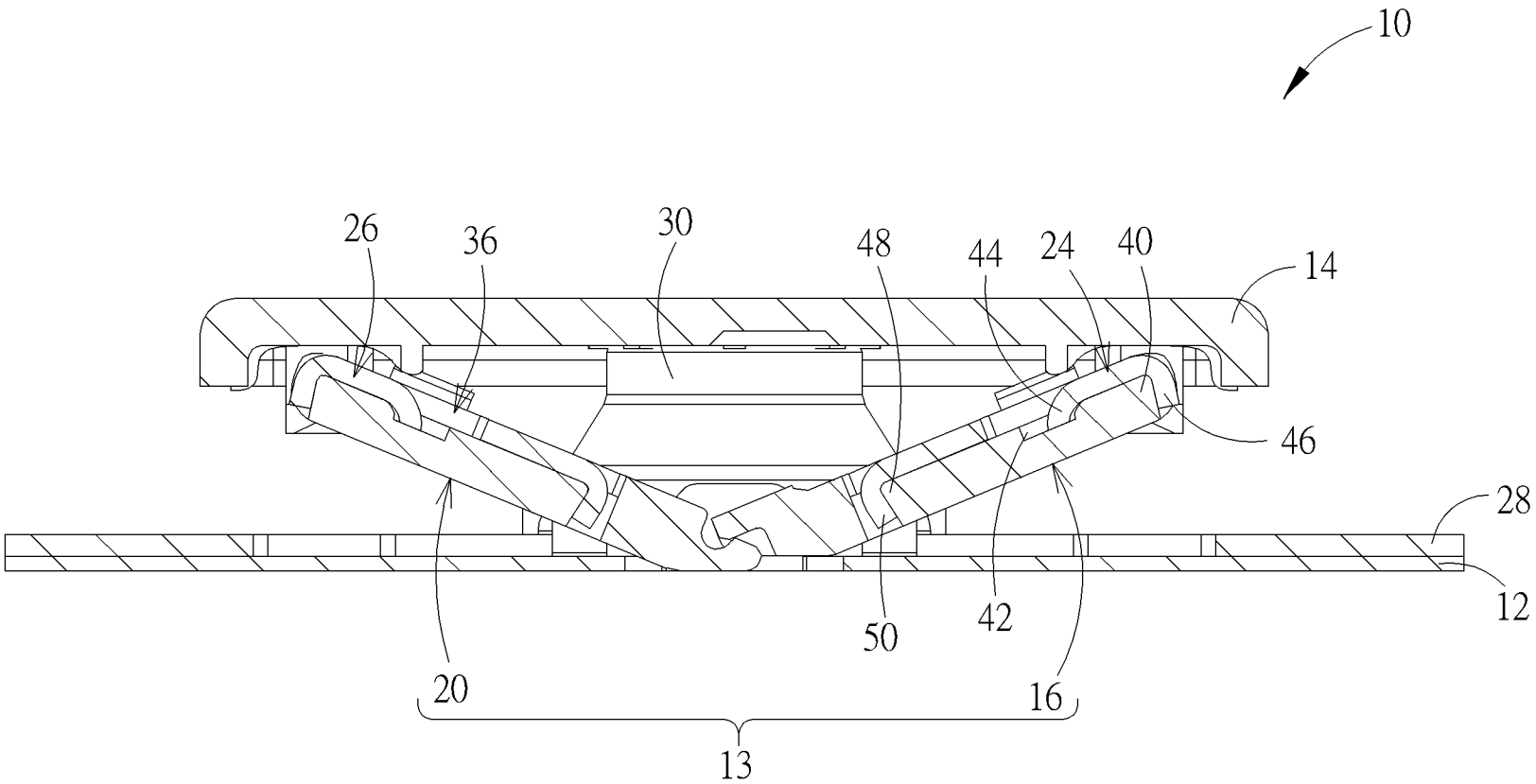
FIG. 4 is a cross-sectional diagram of the keyswitch in FIG. 1 along a cross-sectional line A-A.

Please refer to FIG. 2, FIG. 3, and FIG. 4. FIG. 3 is a partial enlarged diagram of a first support member 16 and a first link member 24 in FIG. 2 at another viewing angle. FIG. 4 is a cross-sectional diagram of the keyswitch 10 in FIG. 1 along a cross-sectional line A-A. As shown in FIG. 2, FIG. 3, and FIG. 4, a first slot structure 32 is formed on the first support member 16, a second slot structure 34 is formed on the second support member 18, a third slot structure 36 is formed on the third support member 20, and a fourth slot structure 38 is formed on the fourth support member 22. A first end portion P1 of the first link member 24 can slide along the first slot structure 32 to a position where the first link member 24 interferes with the first slot structure 32. A second end portion P2 of the first link member 24 can slide along the second slot structure 34 to a position where the first link member 24 interferes with the second slot structure 34. A third end portion P3 of the second link member 26 can slide along the third slot structure 36 to a position where the second link member 26 interferes with the third slot structure 36. A fourth end portion P4 of the second link member 26 can slide along the fourth slot structure 38 to a position where the second link member 26 interferes with the fourth slot structure 38. In such a manner, the present invention can adjust a distance between the first support device 13 and the second support device 15 on the board 12 via the first link member 24 and the second link member 26. The detailed description for the connection design of the first link member 24 and the first support member 16 is provided as follows.

In this embodiment, the first support member 16 has a support end portion P5 to be connected to the cap 14, and the first slot structure 28 has at least one first protruding block 40 (two first protruding blocks 40 spaced apart from each other as shown in FIG. 3, but not limited thereto) and a transverse slot 42. The first protruding block 40 is formed corresponding to the support end portion P5 and is opposite to the transverse slot 42. A sliding block 44 bends from the first end portion P1 of the first link member 24 corresponding to the transverse slot 42, a first hook 46 bends from the first end portion P1 corresponding to the first protruding block 40, and the sliding block 44 is slidably disposed in the transverse slot 42. Furthermore, for enhancing connection strength between the first link member 24 and the first support member 16, the first support member 16 has a linkage end portion P6 to be connected to the third support member 20, and the first slot structure 32 could further have at least one second protruding block 48 (two second protruding blocks 48 spaced apart from each other as shown in FIG. 3, but not limited thereto). The second protruding block 48 is formed corresponding to the linkage end portion P6, and the first protruding block 40 and the second protruding block 48 are located at two sides of the transverse slot 42 respectively. A second hook 50 bends from the first end portion P1 of the first link member 24 corresponding to the second protruding block 48. In such a manner, when the sliding block 44 slides along the transverse slot 42 to make the first hook 46 interfere with the first protruding block 40 and to make the second hook 50 interfere with the second protruding block 48, the first hook 46 can clamp the first support member 16 cooperatively with the second hook 50 and the sliding block 44 (as shown in FIG. 4), so that a position of the first link member 24 on the first support member 16 can be flexibly adjusted.

The aforesaid design, in which the link member clamps the support member via the sliding block of the link member sliding along the transverse slot of the support member to interfere the hook of the link member with the protruding block of the support member, can be applied to connection between the first link member 24 and the second support member 18, connection between the second link member 26 and the third support member 20, and connection between the second link member 26 and the fourth support member 22. The related description could be reasoned by analogy according to the aforesaid embodiment and omitted herein.

Figure 5:
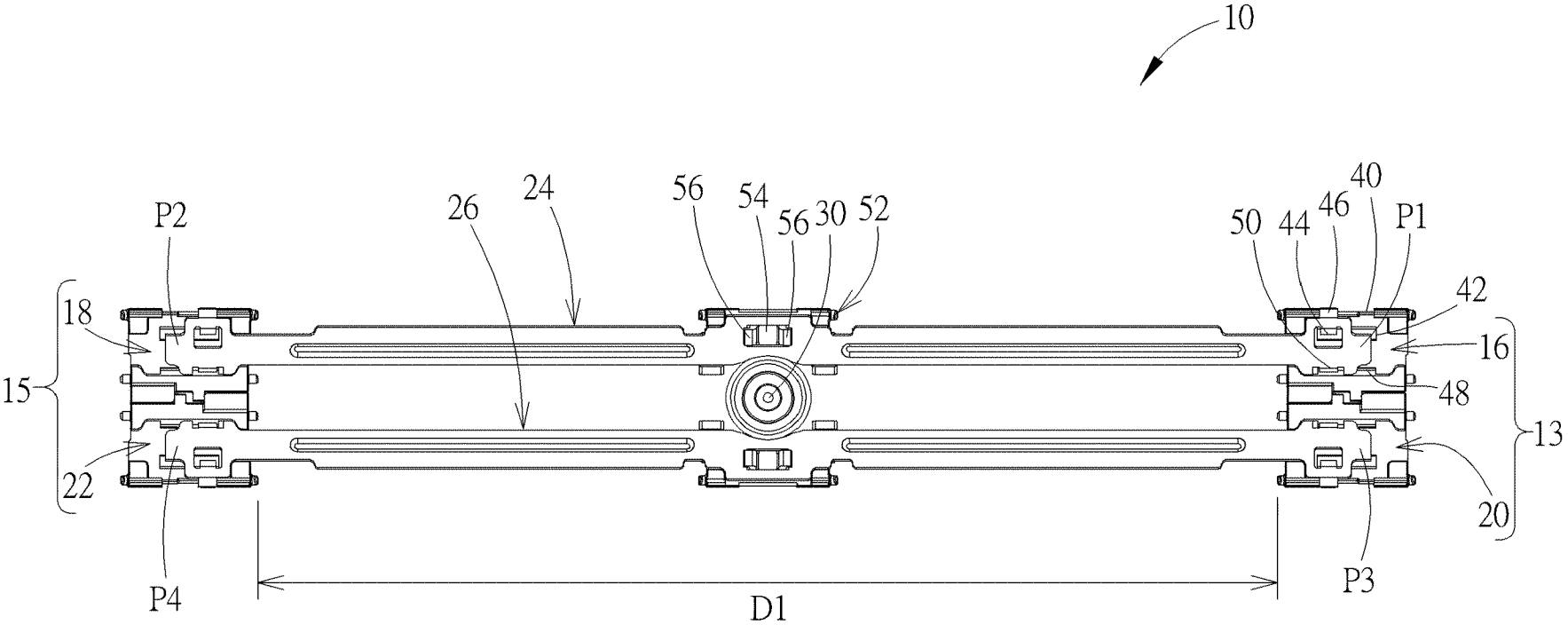
FIG. 5 is a top view of the keyswitch in FIG. 1 after a cap and a circuit board are omitted.
Figure 6:
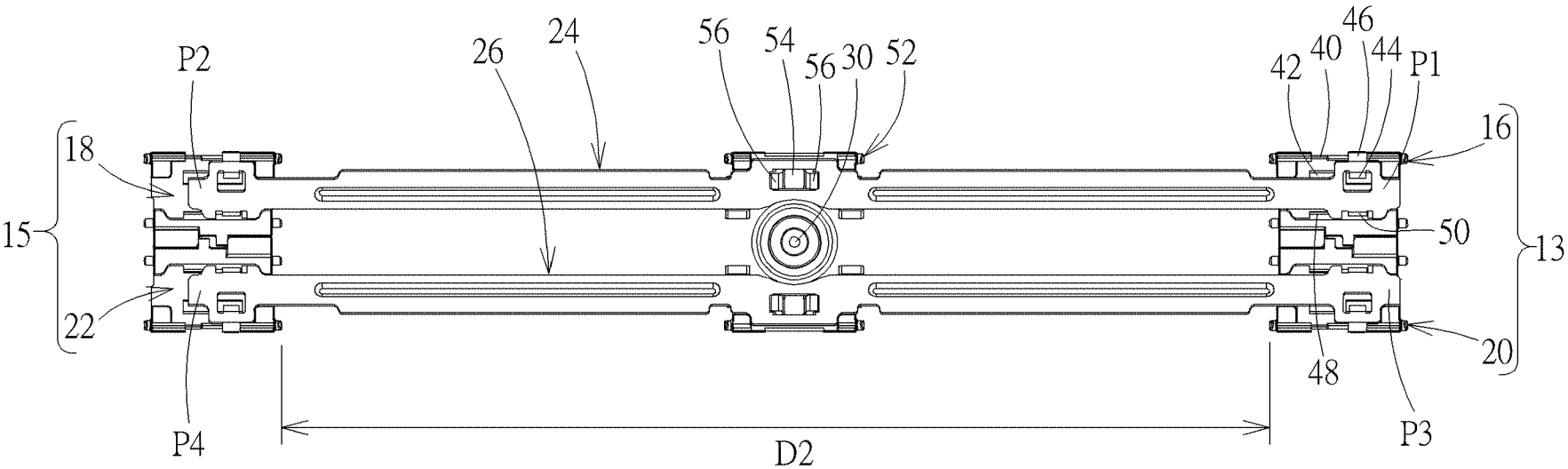
FIG. 6 is a top view of the first support member and a third support member in FIG. 5 moving leftward relative to the first link member and a second link member.
Figure 7:
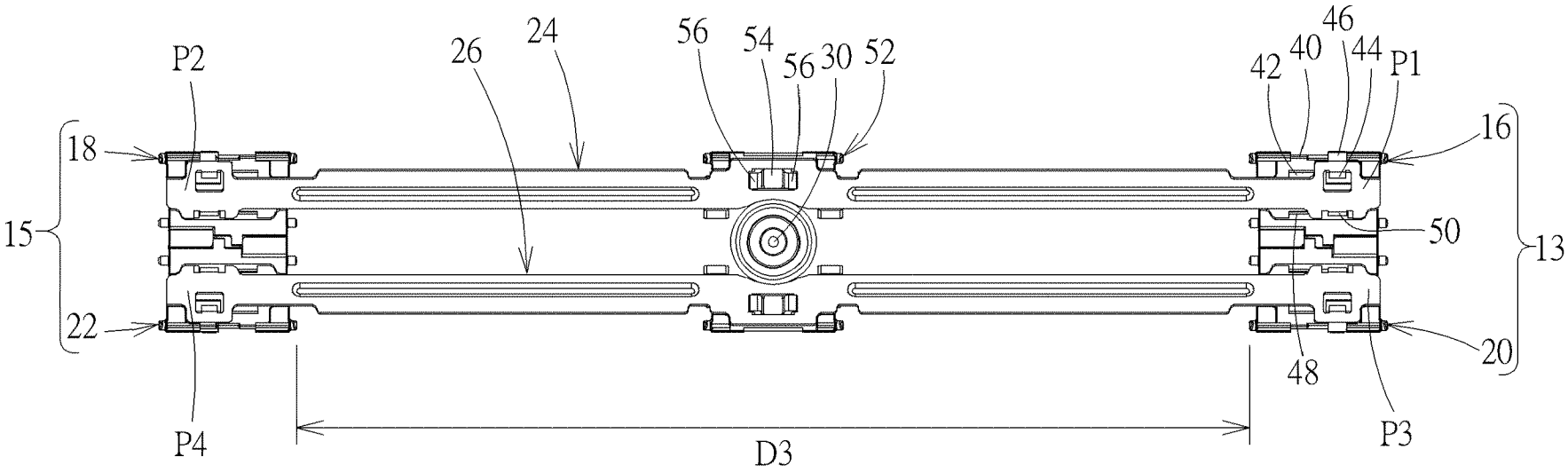
FIG. 7 is a top view of a second support member and a fourth support member in FIG. 6 moving rightward relative to the first link member and the second link member.

Via the aforesaid design, before the first support device 13 and the second support device 15 are connected to the board 12, the present invention can modify the interfering positions of the first link member 24 relative to the first support member 16 and the second support member 18 respectively for adjusting the distance between the first support member 16 and the second support member 18, and can modify the interfering positions of the second link member 26 relative to the third support member 20 and the fourth support member 22 respectively for adjusting the distance between the third support member 20 and the fourth support member 22. As such, the present invention can be suitable for keyswitches of different sizes. For example, please refer to FIG. 4, FIG. 5, FIG. 6, and FIG. 7. FIG. 5 is a top view of the keyswitch 10 in FIG. 1 after the cap 14 and the circuit board 24 are omitted. FIG. 6 is a top view of the first support member 16 and the third support member 20 in FIG. 5 moving leftward relative to the first link member 24 and the second link member 26. FIG. 7 is a top view of the second support member 18 and the fourth support member 22 in FIG. 6 moving rightward relative to the first link member 24 and the second link member 26. As shown in FIG. 4 and FIG. 5, before the first support device 13 and the second support device 15 are connected to the board 12, the first hook 46 and the second hook 50 can interfere with the first protruding block 40 and the second protruding block 48 located at the left side of the first support member 16 respectively for fixing a connection position of the first link member 24 on the first support member 16 (at this time, the first end portion P1 moves to a first position relative to the first support device 13). Similarly, the first link member 24 can interfere with protruding blocks located at the right side of the second support member 18 respectively for fixing a connection position of the first link member 24 on the second support member 18 (at this time, the second end portion P2 moves to a third position relative to the second support device 15). The second link member 26 can interfere with protruding blocks located at the left side of the third support member 20 respectively for fixing a connection position of the second link member 26 on the third support member 20. The second link member 26 can interfere with protruding blocks located at the right side of the fourth support member 22 respectively for fixing a connection position of the second link member 26 on the fourth support member 22. In such a manner, the first support member 16 and the third support member 20 can be spaced apart from the second support member 18 and the fourth support member 22 respectively at a long distance D1 (at this time, the first support device 13 is spaced apart from the second support device 15 at a first distance) to be suitable for a long keyswitch (e.g. a "Shift" key).

Furthermore, as shown in FIG. 6, before the first support device 13 and the second support device 15 are connected to the board 12, the first hook 46 and the second hook 50 can interfere with the first protruding block 40 and the second protruding block 48 located at the right side of the first support member 16 respectively for fixing the connection position of the first link member 24 on the first support member 16 (at this time, the first end portion P1 moves to a second position relative to the first support device 13). Similarly, the first link member 24 can interfere with protruding blocks located at the right side of the second support member 18 respectively for fixing the connection position of the first link member 24 on the second support member 18. The second link member 26 can interfere with protruding blocks located at the right side of the third support member 22 respectively for fixing the connection position of the second link member 26 on the third support member 20. The second link member 26 can interfere with protruding blocks located at the right side of the fourth support member 22 respectively for fixing the connection position of the second link member 26 on the fourth support member 22. In such a manner, the first support member 16 and the third support member 20 can be spaced apart from the second support member 18 and the fourth support member 22 respectively at a medium distance D2 less than the long distance D1 (at this time, the first support device 13 is spaced apart from the second support device 15 at a second distance) to be suitable for a medium keyswitch (e.g. a "Enter" key).

Furthermore, as shown in FIG. 7, before the first support device 13 and the second support device 15 are connected to the board 12, the first hook 46 and the second hook 50 can interfere with the first protruding block 40 and the second protruding block 48 located at the right side of the first support member 16 respectively for fixing the connection position of the first link member 24 on the first support member 16. Similarly, the first link member 24 can interfere with protruding blocks located at the left side of the second support member 18 respectively for fixing the connection position of the first link member 24 on the second support member 18 (at this time, the second end portion P2 moves to a fourth position relative to the second support device 15). The second link member 26 can interfere with protruding blocks located at the right side of the third support member 20 respectively for fixing the connection position of the second link member 26 on the third support member 20. The second link member 26 can interfere with protruding blocks located at the left side of the fourth support member 22 respectively for fixing the connection position of the second link member 26 on the fourth support member 22. In such a manner, the first support member 16 and the third support member 20 can be spaced apart from the second support member 18 and the fourth support member 22 respectively at a short distance D3 to be suitable for a short keyswitch (e.g. a "Tab" key).

In summary, the present invention can modify the interfering position of the link member on the support device to adjust the distance between the two support devices, so as to be suitable for keyswitches of different sizes. Accordingly, the present invention can efficiently decrease the type and number of molds for manufacturing the support devices, so as to reduce the manufacturing cost of the keyboard. Moreover, the first support member 16 and the second support member 18 could have the same structure design, so that the first support member 16 and the second support member 18 could be manufactured by the same mold. Similarly, the third support member 20 and the fourth support member 22 could have the same structure design, so that the third support member 20 and the fourth support member 22 could be manufactured by the same mold. As such, the manufacturing cost of the keyswitch can be reduced.

It should be mentioned that the interference design for the hook and the protruding block is not limited to the multi-stage adjustment design mentioned in the aforesaid embodiment. In another embodiment, the present invention could adopt the design that the hook could slidably interfere with one single protruding block continuously formed on the support member. As such, the distance between the support devices can be modified by sliding the hook of the link member to different interfering positions on one single protruding block, so as to achieve the stepless adjustment purpose. In addition, the second link member 26, the second slot structure 34, the third slot structure 36, and the fourth slot structure 38 are omissible components for simplifying the mechanical design of the keyswitch 10. For example, in another embodiment that the second link member, the second slot structure, the third slot structure, and the fourth slot structure are omitted, the keyswitch of the present invention could only utilize the first link member to connect to the first support member and the second support member respectively and slide along the first slot structure to a position where the first link member interferes with the first slot structure. Accordingly, the distance between the first support member and the second support member can be adjusted by modifying the interfering position of the first link member relative to the first support member.

In the practical application, as shown in FIG. 2, the keyswitch 10 could further include an auxiliary link member 52. The auxiliary link member 52 is connected to the first link member 24 and pivoted to the cap 14 to make the first link member 24 movable together with the cap 14, so as to efficiently improve synchronization of the keyswitch 10 in pressing the cap 14. To be more specific, in this embodiment, an engaging slot 54 could be preferably formed between the first end portion P1 and the second end portion P2 of the first link member 24, and two hooks 56 bend from the auxiliary link member 52 corresponding to the engaging slot 54. As such, the two hooks 56 can be engaged with two sides of the engaging slot 54 to fix the auxiliary link member 52 to the first link member 52 steadily.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a board;

a cap opposite to the board;

a first support device disposed between the cap and the board, one end of the first support device being connected to the board, another end of the first support device being connected to the cap;

a second support device disposed between the cap and the board and spaced apart from the first support device at a specific distance, an end of the second support device being connected to the board, another end of the second support device being connected to the cap; and a first link member having a first end portion and a second end portion, the first end portion being movably connected to the first support device to be movable between a first position and a second position relative to the first support device, the second end portion being connected to the second support device;

wherein when the first end portion moves to the first position relative to the first support device, the first support device is spaced apart from the second support device at a first distance; when the first end portion moves to the second position relative to the first support device, the first support device is spaced apart from the second support device at a second distance; the first distance is larger than the second distance.

2. The keyswitch of claim 1, wherein the second end portion is movably connected to the second support device to be movable between a third position and a fourth position relative to the second support device.

3. The keyswitch of claim 1, wherein the first support device includes a first support member and a third support member, the second support device includes a second support member and a fourth support member, the first support member is disposed between the cap and the board and has a first slot structure formed thereon, the second support member is disposed between the cap and the board, the third support member is disposed between the cap and the board and is connected to the first support member to make the first support member rotatable together with the third support member, the fourth support member is disposed between the cap and the board and is connected to the second support member to make the second support member rotatable together with the fourth support member, the first end portion of the first link member slides along the first slot structure to a position where the first link member interferes with the first slot structure for adjusting a distance between the first support member and the second support member on the board, and a second end portion of the first link member is connected to the second support member.

4. The keyswitch of claim 3, wherein the first support member has a support end portion to be connected to the cap, the first slot structure has at least one first protruding block and a transverse slot, the at least one first protruding block is formed corresponding to the support end portion and opposite to the transverse slot, a sliding block bends from the first end portion of the first link member corresponding to the transverse slot, a first hook bends from the first end portion of the first link member corresponding to the at least one first protruding block, and the sliding block is slidably disposed in the transverse slot;

wherein when the sliding block slides along the transverse slot to make the first hook interfere with the at least one first protruding block, the first hook and the sliding block clamps the first support member cooperatively for adjusting the distance between the first support member and the second support member on the board.

5. The keyswitch of claim 4, wherein the first support member has a linkage end portion to be connected to the third support member, the first slot structure further has at least one second protruding block formed corresponding to the linkage end portion, the first protruding block and the second protruding block are located at two sides of the transverse slot respectively, a second hook bends from the first end portion of the first support member corresponding to the at least one second protruding block, the sliding block is slidably disposed in the transverse slot;

wherein when the sliding block slides along the transverse slot to make the second hook interfere with the at least one second protruding block, the first hook clamps the first support member cooperatively with the sliding block and the second hook.

6. The keyswitch of claim 3, wherein the second support member has a second slot structure formed thereon, the second end portion of the first link member slides along the second slot structure to a position where the first link member interferes with the second slot structure for adjusting the distance between the first support member and the second support member on the board.

7. The keyswitch of claim 6, wherein the second support member has a support end portion to be connected to the cap, the second slot structure has at least one protruding block and a transverse slot, the at least one protruding block is formed corresponding to the support end portion and opposite to the transverse slot, a sliding block bends from the second end portion of the first link member corresponding to the transverse slot, a hook bends from the second end portion of the first link member corresponding to the at least one protruding block, and the sliding block is slidably disposed in the transverse slot;

wherein when the sliding block slides along the transverse slot to make the hook interfere with the at least one protruding block, the hook and the sliding block clamps the second support member cooperatively for adjusting the distance between the first support member and the second support member on the board.

8. The keyswitch of claim 6, wherein the third support member has a third slot structure formed thereon, and the keyswitch further comprises a second link member, a third end portion of the second link member slides along the third slot structure to a position where the second link member interferes with the third slot structure for adjusting the distance between the first support member and the second support member on the board and a distance between the fourth support member and the third support member on the board cooperatively with the first link member, and a fourth end portion of the second link member is connected to the fourth support member.

9. The keyswitch of claim 8, wherein the third support member has a support end portion to be connected to the cap, the third slot structure has at least one protruding block and a transverse slot, the at least one protruding block is formed corresponding to the support end portion and opposite to the transverse slot, a sliding block bends from the third end portion of the second link member corresponding to the transverse slot, a hook bends from the third end portion of the second link member corresponding to the at least one protruding block, and the sliding block is slidably disposed in the transverse slot;

wherein when the sliding block slides along the transverse slot to make the hook interfere with the at least one protruding block, the hook and the sliding block clamps the third support member cooperatively for adjusting the distance between the third support member and the fourth support member on the board.

10. The keyswitch of claim 8, wherein the fourth support member has a fourth slot structure formed thereon, the fourth end portion of the second link member slides along the fourth slot structure to a position where the second link member interferes with the fourth slot structure for adjusting the distance between the third support member and the fourth support member on the board.

11. The keyswitch of claim 10, wherein the fourth support member has a support end portion to be connected to the cap, the fourth slot structure has at least one protruding block and a transverse slot, the at least one protruding block is formed corresponding to the support end portion and opposite to the transverse slot, a sliding block bends from the fourth end portion of the second link member corresponding to the transverse slot, a hook bends from the fourth end portion of the second link member corresponding to the at least one protruding block, and the sliding block is slidably disposed in the transverse slot;

wherein when the sliding block slides along the transverse slot to make the hook interfere with the at least one protruding block, the hook and the sliding block clamps the fourth support member cooperatively for adjusting the distance between the third support member and the fourth support member on the board.

12. The keyswitch of claim 3, wherein the first support member and the third support member are opposite to each other and abut against each other to form a butterfly lifting mechanism, and the second support member and the fourth support member are opposite to each other and abut against each other to form a butterfly lifting mechanism.

13. The keyswitch of claim 3, wherein the third support member has a third slot structure formed thereon, and the keyswitch further comprises a second link member, a third end portion of the second link member slides along the third slot structure to a position where the second link member interferes with the third slot structure for adjusting the distance between the first support member and the second support member on the board and a distance between the fourth support member and the third support member on the board cooperatively with the first link member, and a fourth end portion of the second link member is connected to the fourth support member.

14. The keyswitch of claim 13, wherein the third support member has a support end portion to be connected to the cap, the third slot structure has at least one protruding block and a transverse slot, the at least one protruding block is formed corresponding to the support end portion and opposite to the transverse slot, a sliding block bends from the third end portion of the second link member corresponding to the transverse slot, a hook bends from the third end portion of the second link member corresponding to the at least one protruding block, and the sliding block is slidably disposed in the transverse slot;

wherein when the sliding block slides along the transverse slot to make the hook interfere with the at least one protruding block, the hook and the sliding block clamps the third support member cooperatively for adjusting the distance between the third support member and the fourth support member on the board.

15. The keyswitch of claim 13, wherein the fourth support member has a fourth slot structure formed thereon, the fourth end portion of the second link member slides along the fourth slot structure to a position where the second link member interferes with the fourth slot structure for adjusting the distance between the third support member and the fourth support member on the board.

16. The keyswitch of claim 15, wherein the fourth support member has a support end portion to be connected to the cap, the fourth slot structure has at least one protruding block and a transverse slot, the at least one protruding block is formed corresponding to the support end portion and opposite to the transverse slot, a sliding block bends from the fourth end portion of the second link member corresponding to the transverse slot, a hook bends from the fourth end portion of the second link member corresponding to the at least one protruding block, and the sliding block is slidably disposed in the transverse slot;

wherein when the sliding block slides along the transverse slot to make the hook interfere with the at least one protruding block, the hook and the sliding block clamps the fourth support member cooperatively for adjusting the distance between the third support member and the fourth support member on the board.

17. The keyswitch of claim 3, further comprising:

an auxiliary link member connected to the first link member and pivoted to the cap to make the first link member movable together with the cap.

18. The keyswitch of claim 17, wherein an engaging slot is formed between the first end portion and the second end portion of the first link member, two hooks bend from the auxiliary link member corresponding to the engaging slot, and the two hooks are engaged with two sides of the engaging slot respectively for fixing the auxiliary link member to the first link member.

* * * * *